US009845631B2

(12) United States Patent
Eggeling et al.

(10) Patent No.: US 9,845,631 B2
(45) Date of Patent: Dec. 19, 2017

(54) DRIVE ARRANGEMENT FOR MOTOR-OPERATED ADJUSTMENT OF A CLOSURE ELEMENT IN A MOTOR VEHICLE

(75) Inventors: Jürgen Eggeling, Mülheim an der Ruhr (DE); Dirk Hellmich, Duisburg (DE); Klaus Dünne, Ratingen (DE)

(73) Assignee: Brose Schliesssysteme GmbH & Co. Kommanditgesellschaft, Wuppertal (DE)

( * ) Notice: Subject to any disclaimer, the term of this patent is extended or adjusted under 35 U.S.C. 154(b) by 0 days.

(21) Appl. No.: 13/128,826

(22) PCT Filed: Oct. 8, 2009

(86) PCT No.: PCT/EP2009/007222

§ 371 (c)(1),
(2), (4) Date: Jul. 25, 2011

(87) PCT Pub. No.: WO2010/054725

PCT Pub. Date: May 20, 2010

(65) Prior Publication Data

US 2011/0271595 A1 Nov. 10, 2011

(30) Foreign Application Priority Data

Nov. 12, 2008 (DE) ..... 10 2008 057 014

(51) Int. Cl.
*E05F 15/622* (2015.01)
*E05F 15/40* (2015.01)
(Continued)

(52) U.S. Cl.
CPC ..... *E05F 15/622* (2015.01); *E05F 15/40* (2015.01); *E05F 15/611* (2015.01); *E05F 1/1058* (2013.01);
(Continued)

(58) Field of Classification Search
CPC .... B60J 5/10; B60J 5/101; B60J 5/106; E05F 15/10; E05F 15/12; E05F 15/122
(Continued)

(56) References Cited

U.S. PATENT DOCUMENTS 4,289,995 A * 9/1981 Sorber et al. ..... 318/9
6,398,288 B1 * 6/2002 Yuge ..... E05F 15/63 296/146.4
(Continued)

FOREIGN PATENT DOCUMENTS

DE 19631861 11/1999
DE 102004017264 A1 11/2004
(Continued)

OTHER PUBLICATIONS

Chinese Search Report, for CN App. 200980145635.8, dated Apr. 19, 2013 (2 pages).
(Continued)

*Primary Examiner* — Katherine Mitchell
*Assistant Examiner* — Catherine A Kelly
(74) *Attorney, Agent, or Firm* — Pauly, DeVries Smith & Deffner LLC

(57) ABSTRACT

Disclosed herein is a drive arrangement for motor-operated adjustment of a closure element in a motor vehicle having at least one drive with a drive motor, and a drive controller. The closure element can be driven in the motor-operated adjustment mode by the drive motor in the closing direction and in the opening direction between a closed and an open position. The drive is non-self-locking and has a sensor, in particular a Hall sensor, for sensing the drive movement. The drive controller monitors the sensor signals for a fault state, and when a fault state is sensed initiates an emergency braking and/or stop mode. The drive arrangement comprises two drives each with a sensor for determining the respective
(Continued)

drive movement. To detect drive-fault-induced slamming shut of the closure element, the drive controller correlates the sensor signals of the two sensors, in particular compares said sensor signals.

25 Claims, 4 Drawing Sheets

(51) Int. Cl.
*E05F 15/611* (2015.01)
*E05F 1/10* (2006.01)

(52) U.S. Cl.
CPC ... *E05Y 2201/434* (2013.01); *E05Y 2400/302* (2013.01); *E05Y 2400/506* (2013.01); *E05Y 2400/514* (2013.01); *E05Y 2400/532* (2013.01); *E05Y 2800/00* (2013.01); *E05Y 2800/21* (2013.01); *E05Y 2800/242* (2013.01); *E05Y 2800/404* (2013.01); *E05Y 2800/409* (2013.01); *E05Y 2900/546* (2013.01)

(58) Field of Classification Search
USPC ..... 49/339, 340, 341, 343; 296/146.9, 56, 296/106, 76; 318/266, 460, 466
See application file for complete search history.

(56) References Cited

U.S. PATENT DOCUMENTS 6,516,567 B1 2/2003 Stone et al.
7,070,226 B2 * 7/2006 Cleland et al. ..... 296/146.8
7,219,945 B1 * 5/2007 Zinn ..... B60J 5/101 296/56
2004/0061468 A1 * 4/2004 Kurosawa et al. ..... 318/466
2004/0212334 A1 * 10/2004 Kawanobe ..... E05F 15/40 318/280
2006/0181108 A1 * 8/2006 Cleland ..... E05F 15/63 296/146.4
2007/0114956 A1 * 5/2007 Hashimoto ..... 318/139
2007/0137331 A1 * 6/2007 Kachouh ..... 74/89.23
2008/0276537 A1 * 11/2008 Hanna ..... E05F 15/622 49/343

FOREIGN PATENT DOCUMENTS

DE 202005003466 8/2006
DE 202005007155 U1 9/2006
DE 202007002306 U1 6/2008
EP 0961863 12/1999
GB 2400890 A * 10/2004 ..... E05F 15/12
JP 10184187 7/1998
JP 2002227522 A 8/2002
JP 2004324264 A 11/2004

OTHER PUBLICATIONS

"German Search Report", for DE App. 102008057014.1-23, dated Jul. 3, 2009 (3 pages).
"International Preliminary Report on Patentability", for PCT App. PCT/EP2009/007222, dated May 17, 2011 (6 pages).

* cited by examiner

DRIVE ARRANGEMENT FOR MOTOR-OPERATED ADJUSTMENT OF A CLOSURE ELEMENT IN A MOTOR VEHICLE

CROSS REFERENCE TO RELATED APPLICATIONS

This application is a national stage application under 35 U.S.C. 371 of International Patent Application Serial No. PCT/EP2009/007222, entitled "DRIVE ARRANGEMENT FOR MOTOR-OPERATED ADJUSTMENT OF A CLOSURE ELEMENT IN A MOTOR VEHICLE," filed Oct. 8, 2009, which claims priority from German Patent Application No. 10 2008 057 014.1, filed Nov. 12, 2008, the disclosures of which are incorporated herein by reference.

FIELD OF THE INVENTION

The invention relates to a drive arrangement for motor-operated adjustment of a closure element in a motor vehicle, and to a closure element arrangement in a motor vehicle.

BACKGROUND OF THE INVENTION

The term "closure element" is to be understood here in an inclusive fashion. It includes tailgates, trunk lids, engine hoods, side doors, sliding doors, lifting roofs, sliding windows, etc.

However, the drive arrangement in question is primarily applied in tailgates and side doors in motor vehicles. It serves for motor-operated adjustment of the respective closure element in the closing direction and in the opening direction.

The prior art drive arrangement (DE 20 2005 007 155 U1) on which the invention is based is assigned to a tailgate of a motor vehicle. The drive arrangement is equipped with two spindle drives which each have, in a compact structural unit, a drive motor, an intermediate transmission with a clutch and a spindle gear. A spring arrangement, which counteracts the weight of the assigned tailgate, is provided in the respective structural unit.

The prior art drive arrangement also has a drive controller which serves to actuate the two drives, in particular the two drive motors. The drives are generally each configured with a sensor for sensing the drive movement. Tailgates of considerable size and/or considerable weight can be adjusted by motor with the prior art drive arrangement. This opens new degrees of freedom in the configuration of such tailgates. However, the increase in the weight basically also involves an increased risk when the drive arrangement fails.

In the most unfavorable case, the drive connection between the drive arrangement and the tailgate ruptures, which can cause the tailgate to suddenly slam shut. This involves overall a considerable reduction of the operational safety of the tailgate arrangement.

SUMMARY OF THE INVENTION

The invention is based on the problem of configuring and developing the known drive arrangement in such a way that the operational safety is increased.

The above problem is solved in a drive arrangement for motor-operated adjustment of a closure element in a motor vehicle, wherein at least one drive with a drive motor, and a drive controller are provided, wherein the closure element can be driven in the motor-operated adjustment mode by means of the drive motor in the closing direction and in the opening direction between a closed position and an open position, wherein the drive is of non-self-locking design, wherein the drive has a sensor, such as a Hall sensor, for sensing the drive movement, wherein the drive controller monitors the sensor signals for a fault state, and when a fault state is detected, the drive controller initiates an emergency braking mode and/or an emergency stop mode. The above problem is also solved in a drive arrangement that comprises two drives, each with a sensor for determining the respective drive movement. In order to detect potential slamming shut of the closure element induced by a fault, the drive controller in such an arrangement correlates the sensor signals of the two sensors with one another. An example of the drive controller correlating the sensor signals includes the drive controller comparing the sensor signals with one another.

It is essential that the drive controller monitor the sensor signals of the one or more sensors of the corresponding one or more drives for a fault state and initiate an emergency braking mode and/or an emergency stop mode when a fault state is detected. It has been realized here that the sensor signals which serve to control the movement per se can be used to detect deviations from the normal operating state.

In one embodiment, the drive controller monitors for a fault state that relates to the closure element being induced to slam shut by a fault. This fault state is in the spotlight here.

In the particular case of a drive arrangement with two drives, the teaching is based on a fault state in which one of the two drives of the drive arrangement becomes disengaged from the closure element. This disengagement fault induces the closure element to slam shut. According to the proposal herein, this fault state is detected by correlating the sensor signals of the two sensors with one another. In the simplest case, a comparison of the sensor signals of the two sensors takes place here.

In another embodiment, it has been detected that one or more drive motors of the corresponding one or more drives can readily be actuated in such a way that the braking effect which is necessary for the emergency braking mode or the emergency stop mode is brought about.

There are, at any rate, two possible ways of generating the abovementioned braking effect of the drive motor. One way is to connect the drive motor to a short circuit, preferably in a pulsed fashion. As a result, a braking effect is generated which is due to the Lorentz force. Another way of generating the braking effect of the drive motor is to apply a preferably pulsed countervoltage and/or a preferably pulsed countercurrent to the drive motor. As a result, an even stronger braking effect than with the short-circuit braking can be achieved.

According to a further teaching, which is also attributed independent significance, a closure element arrangement which has a closure element on one hand and a drive arrangement on the other is claimed as such. Reference can be made to the full scope of the statements relating to possible variants of the closure element and of the drive arrangement.

BRIEF DESCRIPTION OF THE FIGURES

Further details, features, objectives and advantages of the present invention will be explained in more detail below with reference to the drawing of a preferred exemplary embodiment. In the drawing.

DETAILED DESCRIPTION

Figure 1:
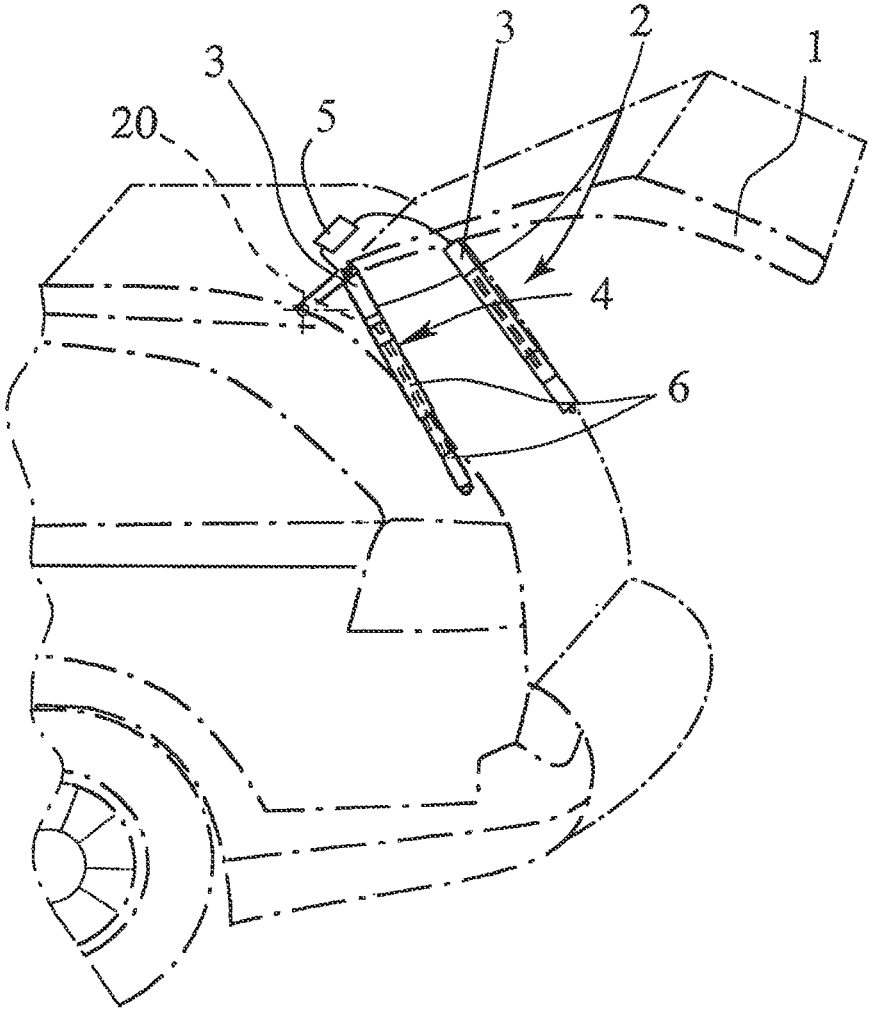
FIG. 1 shows the rear of a motor vehicle in a side view with a tailgate and a drive arrangement, according to the proposal, for the motor-operated adjustment of the tailgate.

The drive arrangement illustrated in FIG. 1 serves for motor-operated adjustment of a tailgate 1 in a motor vehicle. However, all other closure elements which are referred to in the introductory part of the description can advantageously be used. All the following statements relating to a tailgate apply correspondingly to the same extent to all other closure elements which are referred to herein.

Figure 2:
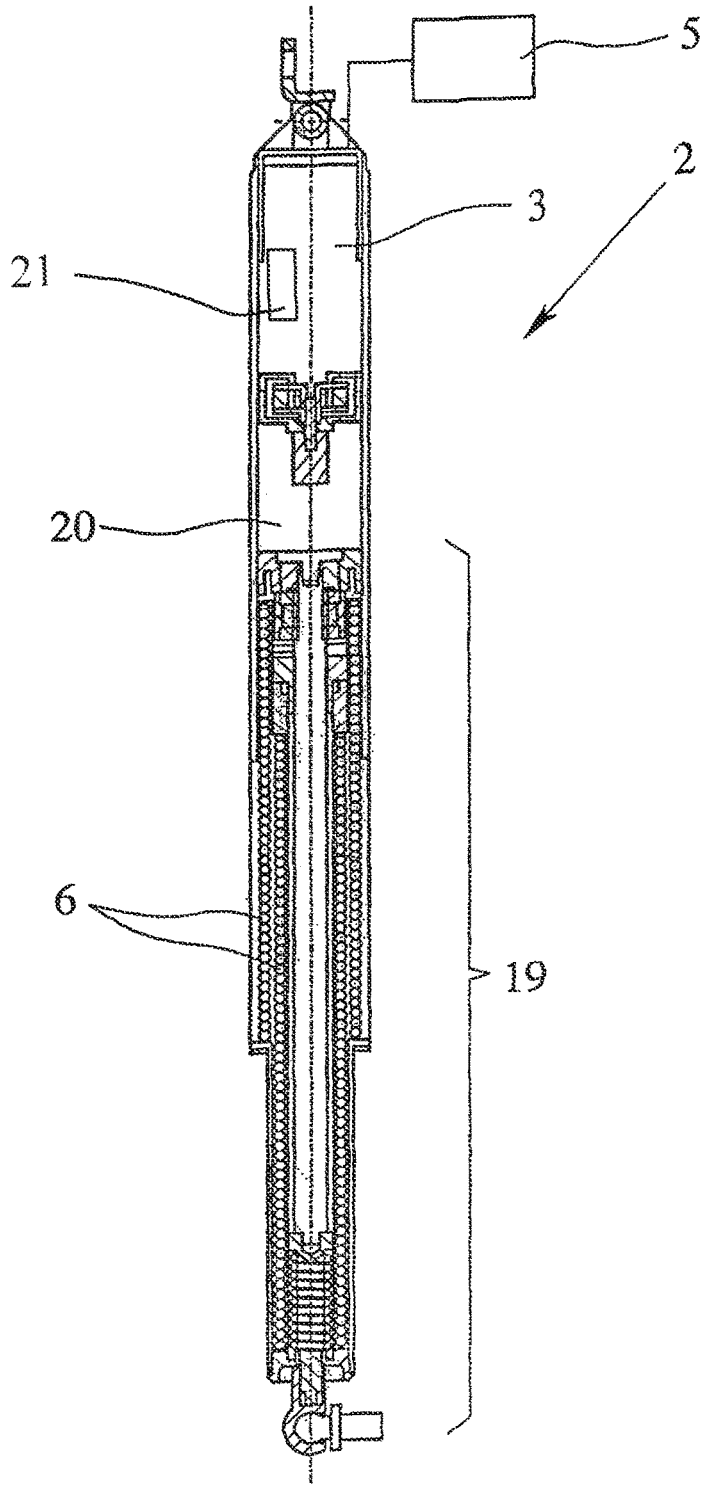
FIG. 2 shows a drive of the drive arrangement according to FIG. 1 in a sectional illustration.

As a basic proposition, a drive arrangement can have one or more drives. For example, a single drive can be assigned to a drive arrangement. FIG. 1 illustrates an example of a drive arrangement that is assigned two identical drives 2. Each of the two drives 2 shown in FIG. 1 has a drive motor 3. The drives 2 are arranged in the two lateral areas of a tailgate opening 4. FIG. 2 shows a sectional view of one of the drives 2.

The following statements apply to the drives 2 which can be seen in FIG. 1.

In addition, in specific application cases a single drive motor, such as one of the drive motors 3 of FIG. 1, can be assigned to a plurality of drives, such as the two drives 2 of FIG. 1. In such an example, a single drive motor is preferably assigned to two drives. The plurality of drives in that case share the one drive motor.

Returning to the example in the figures, a single drive controller 5 is assigned to the two drives 2 shown in FIG. 1. The drive controller 5 will be explained in more detail below.

All the exemplary embodiments have in common the fact that the tailgate 1 can be driven in the motor-operated adjustment mode by means of the drive motors 3 in the closing direction and in the opening direction between a closed position and an open position.

In the mounted state, the arrangement is such that the weight of the closure element 1 acts in the closing direction. In this case, the two drives 2 are not configured here in a self-locking way, with the result that the weight of the closure element 1 can basically trigger a closing movement of the closure element 1. In order to prevent this, a prestressing of the drives 2 and/or of the closure element 1 is generally provided, as will be explained.

Referring to FIG. 2, the drive 2 is equipped with a sensor 21 for sensing the drive movement. The sensor 21 is preferably a Hall sensor which interacts with a magnet arranged on a drive shaft.

It is essential that the drive controller 5 monitor the sensor signals of the sensor 21 of each of the drives 2 for a fault state. The drive controller 5 initiates an emergency braking mode and/or an emergency stop mode when a fault state is detected.

There is primarily provision here that the drive controller 5 monitors the sensor signals of the sensors 21 for a fault state that indicates the closure element 1 is potentially slamming shut. Such potential slamming shut can be induced or caused, in particular, by a fault such as a rupturing of a drive component of the drive arrangement. It will be explained further below which drive component this may be.

Specifically when a drive component ruptures, the slamming shut movement will take place suddenly. Against this background, there is preferably provision that, in order to detect the closure element 1 potentially slamming shut due to a fault, the drive controller 5 checks the sensor signals for sudden signal deviations. By way of clarification it can be stated in this respect that this means a deviation with respect to the signal profile occurring in the normal operating mode.

It has already been mentioned further above that the closure element 1 may be induced to slam shut by a fault during a fault state in which one of the drives 2 becomes disengaged from the closure element 1. This is the case in the illustrated exemplary embodiment if, during the loading when the tailgate 1 is opened, a strong shock is inadvertently applied to one of the drives 2. Such a shock ruptures the drive coupling between the drive 2 and the tailgate 1 and/or the motor vehicle bodywork. This generally causes the tailgate 1 to slam shut owing to the weight of the tailgate.

For the above case it is appropriate that the drive controller 5 initiates an emergency braking mode and/or an emergency stop mode only for that drive 2 that is not in the fault-induced state. This method of actuation is particularly advantageous for a case in which the emergency braking mode and/or the emergency stop mode is due to inverse energization of one of the drives 2, as will be explained.

For a drive arrangement with two drives 2, each drive 2 can have a sensor 21. If the closure element 1 is induced to slam shut by a fault, this fault state can be detected by virtue of the fact that the sensor signals from the two sensors 21 are correlated with one another. This means that the sensor signals of the two sensors 21 can be processed with one another in some way or other, so that the presence of the fault state can be detected from the result of the processing.

In the simplest case, the sensor signals of the two sensors 21 are largely identical to one another in the normal operating mode. This is also the case in the illustrated exemplary embodiment with identical drives 2. In particular it is sufficient that the sensor signals of the two sensors 21 are compared with one another, wherein the upward transgression of a predetermined signal deviation implies the occurrence of the fault state.

It may also be possible to detect a fault state, such as a fault-induced potential slamming shut of the closure element 1, by using the drive controller 5 to monitor the upward transgression of a predetermined limiting difference in the drive speed or the drive travel experienced by the two drives 2. Other possible ways of detecting the fault state are conceivable.

In some cases the two drives 2 are prestressed in the opening direction, specifically in such a way that the prestressing counteracts the weight of the tailgate 1. This will be explained in more detail below. Such prestressing generally leads, in the case of the above situation where one of the drives 2 becomes disengaged from the closure element 1, to a situation in which the drive 2 carries out a sudden drive movement in the opening direction due to the prestressing. Against this background, there is preferably provision that the drive controller 5 monitors the sensor signals for a fault state that includes this sudden drive movement in the opening direction which is caused, in particular by the prestressing of the drives 2.

In this context there is also preferably provision that the drive controller 5 initiates an emergency braking mode and/or emergency stop mode only for that drive 2 for which no sudden drive movement in the opening direction has just been sensed. In other words, when only one of the signals from one of the sensors 21 indicates the fault state of a sudden drive movement in the opening direction, the drive controller 5 only initiates the emergency braking mode and/or emergency stop mode for the one of the two drives 2 with the sensor 21 signal that did not indicate the fault state (which in this case is a sudden drive movement in the opening direction).

Various possible ways of implementing the emergency braking mode and the emergency stop mode are conceivable.

For example, it is conceivable that the drive arrangement has an actuable brake arrangement, and that, in order to initiate the emergency braking mode and/or the emergency stop mode, the drive controller 5 correspondingly actuates the brake arrangement. Given corresponding configuration of the brake arrangement, the necessary braking effect can be achieved quickly and reliably.

In a particularly preferred embodiment there is, however, provision that, in order to initiate the emergency braking mode and/or the emergency stop mode, the drive controller 5 actuates the drive motor 3 in such a way that said drive motor 3 acts in a braking fashion on adjustment of the closure element 1. The fact that additional structural measures, such as the provision of a brake arrangement, can be dispensed with is advantageous here.

The weight of the tailgate 1 can be of a considerable magnitude so that preferably a spring arrangement 6 is provided which at any rate compensates the weight of the tailgate 1 over an adjustment range of the tailgate 1. This is generally intended to ensure that the tailgate 1 is always located in the vicinity of a state of equilibrium. However, it may also be advantageous to provide over-compensation in such a way that the tailgate 1 is predisposed to move in the opening direction. The spring arrangement 6 preferably brings about the already abovementioned prestressing of the two drives 2 in the opening direction here. However, it is also conceivable that a spring arrangement is provided separately from the two drives 2. This generally comprises gas compression springs or the like.

In the case of a spring fracture, the potential fault state of the undesired potential slamming shut of the tailgate 1 is associated with all spring arrangements which counteract the weight of the tailgate 1.

It is basically conceivable that, in order to initiate the emergency operating mode and/or the emergency stop mode, the braking of the drive motor 3 takes place in an uncontrolled fashion. However, the braking drive motor 3 preferably takes place in a controlled fashion.

Figure 3:
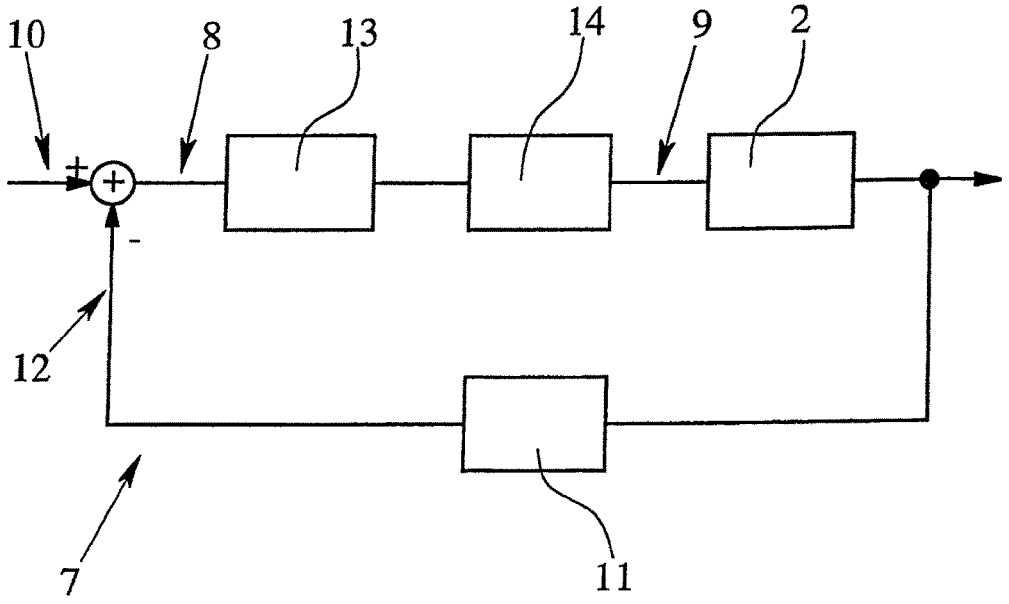
FIG. 3 is a schematic view of the control system of the drive controller of the drive arrangement according to FIG. 1.

The drive controller 5 preferably has a control loop for controlling the motor-operated adjustment of the closure element 1. Referring to FIG. 3, the control loop 7 generates a manipulated variable 9 in the motor-operated adjustment mode on the basis of a control error, and the drive motor 3 acts in a controlled driving fashion or controlled braking fashion as a function of the manipulated variable 9. The terms "controlled driving fashion" and "controlled braking fashion" preferably mean here that the braking effect is not only switched on and off but is also "metered", as is the driving effect of the drive motor 3. Preferred variants of such metered "braking" will be explained below.

Continuing with the example in FIG. 3, a reference variable 10, which represents, for example, the setpoint speed of the tailgate 1, is compared with an actual variable 12 which is measured by a sensor 11, and is converted into the abovementioned control error 8. The sensor 11 is preferably the sensor 21 of one of the two drives 2. The manipulated variable 9, which is also referred to above, for the drive 2, in particular for the drive motor 3, is generated in a control element 13 and in a downstream actuator element 14 on the basis of the control error 8.

Equipping the drive controller 5 with the control loop 7 provides a particularly easy way to detect the above fault state. Such detection is then based on the detection of a sudden control error, caused, for example, by the mechanical rupture of a spring arrangement 6 which is assigned to the drive 2.

Figure 4:
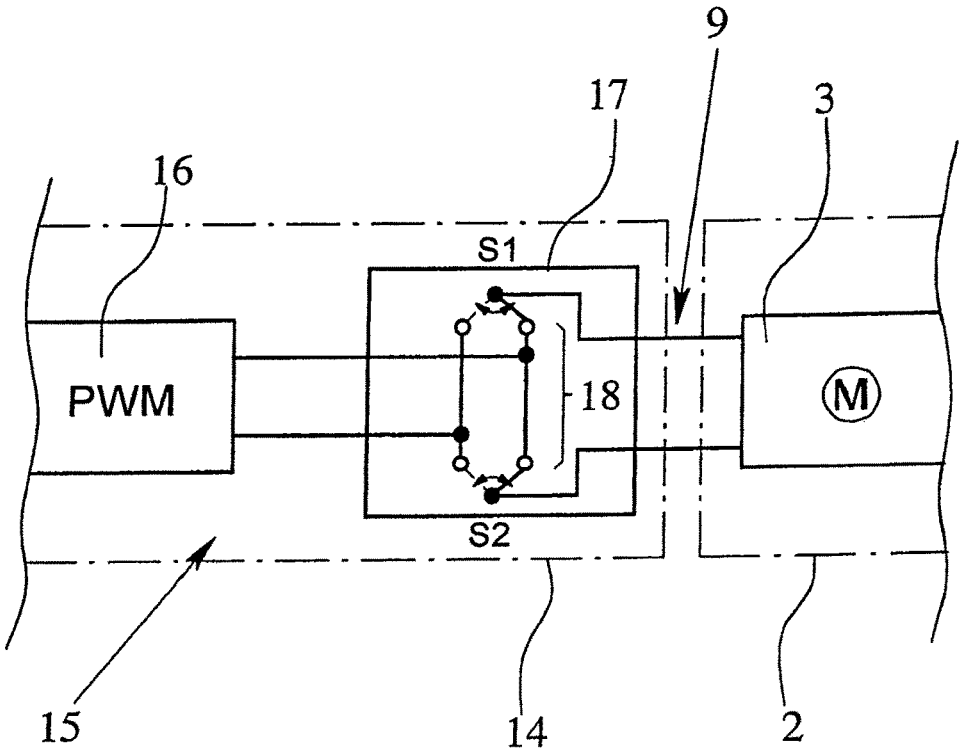
FIG. 4 shows the power output stage of the drive controller of the drive arrangement according to FIG. 1.

FIG. 4 shows a power output stage 15 which is assigned to the drive motor 3 and which has a PWM (Pulse Width Modulation) generator 16 as voltage source and a switching unit 17 connected downstream of the PWM generator 16. The switching unit 17 serves firstly for bidirectional connection of the drive motor 3 to the pulsed supply voltage, which is necessary for the bidirectional adjustment of the tailgate 1 in the closing direction and in the opening direction. For this purpose, the switching unit 17 has the switches S1 and S2, which are alternately switched depending on the adjustment direction. In one of the adjustment directions, the switching vane of the switch S1 is in the right-hand position and the switching vane of the switch S2 is in the left-hand position. This situation is correspondingly reversed for the opposing adjustment direction.

One particularly simple possible way of implementing the above braking effect of the drive motor 3 is also shown in FIG. 4. In order to generate the braking effect for the emergency braking mode and/or the emergency stop mode, the drive controller 5 preferably connects the drive motor 3 here to a short circuit 18. This is the case if the switching vanes of the two switches S1 and S2 which are illustrated in FIG. 4 are in the right-hand position (FIG. 4).

The variant of short-circuit braking illustrated in FIG. 4 is easy to implement, but it does not permit any "metered" braking. This can be basically achieved by virtue of the fact that, in order to generate the braking effect, the drive controller 5 connects the drive motor 3 in a pulsed fashion to a short circuit 18. This is preferably done in pulsed width modulation.

In the embodiment which is illustrated in FIG. 4 and to this extent preferred, the short circuit 18 is configured in the manner of an ideal electrical short-circuit bridge. However, it is also conceivable to configure the short circuit 18 in the manner of a resistance bridge, wherein the effect of the short circuit 18 can also preferably be set by means of the drive controller 5 in that the resistance value of the resistance bridge can be set by means of the drive controller 5.

Numerous variants are conceivable for the circuitry implementation of the bidirectional actuation on the one hand and the short-circuit braking on the other. The switching unit 17 can, for example, be configured as a relay. However, it is also possible for the bidirectional actuation to the preferably implemented as a full bridge in an integrated component, and for the short-circuit braking to be implemented in a separate relay.

The explained braking effect of the drive motor by short circuiting is based, as mentioned above, on the Lorentz principle. However, this means that this cannot be used to implement braking as far the stationary state in the case of continuous loading of the tailgate 1, for example by weight.

Alternatively or additionally there is therefore preferably provision that, in order to generate a braking effect, the drive controller 5 applies a countervoltage and/or a countercurrent to the drive motor 3. The countervoltage and/or countercurrent counteracts the respective adjustment movement. This can be readily implemented with the power output stage 15 illustrated in FIG. 3 since the drive direction can, of course, be reversed through alternating connection of the switches S1 and S2. In order also to permit "metered" braking here, the drive controller 5 preferably applies a pulsed countervoltage and/or a pulsed countercurrent to the drive motor 3 in order to generate the braking effect, wherein the countervoltage and/or the countercurrent are also preferably pulsed in the manner of a pulse width signal. The metered braking can, however, also easily be implemented by setting the level of the countervoltage or of the countercurrent. In the case of the situation where the drive 2 becomes disengaged from the closure element 1, the braking takes place with the countervoltage or with the countercurrent preferably only when the remaining drive 2 is in drive engagement. Otherwise, the disengaged drive 2 would carry out a drive movement in the opening direction, which is possibly associated with the risk of injury to the user. This basic concept of "one-sided" braking has already been mentioned further above.

Depending on the embodiment of the closure element 1, the emergency stop mode is associated with a continuous power drain by the drive motor 3. This is the case with the tailgate 1 which is illustrated in FIG. 1, due to the effect of weight. For this reason, there is preferably provision that the drive controller 5 remains in the stop mode only for a predetermined stopping time, and preferably motor-operated resetting of the tailgate 1 preferably into the closed position, occurs after the expiry of the stopping time. In a particularly preferred embodiment, the resetting takes place at a reduced speed. It has become apparent that stopping times between 20 and 30 minutes produce a good compromise between energy consumption on the one hand and user comfort on the other.

During the controlled stopping of the tailgate 1 above, the tailgate 1 is continuously braked and driven. The braking is carried out here by means of the abovementioned application of a countervoltage and/or a countercurrent to the drive motor 3. It goes without saying that the short-circuit braking above does not permit the tailgate 1 to be returned from deflected position into the stop position.

The utilization of the braking effect of a drive motor 3 according to the proposal can be freely applied to all possible structural variants. One particularly preferred drive 2 is illustrated in FIG. 2. In addition to the drive motor 3, the drive 2 has a spindle gear 19 which is connected downstream of the drive motor 3, wherein an intermediate mechanism 20 including a clutch is preferably connected between the drive motor 3 and the spindle gear 19 here. The spring arrangement 6 is integrated into the drive 2, with the result that overall a particularly compact embodiment is obtained. With respect to the structural configuration of the drive 2, in particular with respect to the structural configuration of the spring arrangement 6, reference can be made to German application DE 20 2005 007 155 U1, which is by the applicant and which is herewith made, in its entire scope, a subject matter of the present application.

It has already been pointed out that the teaching according to the proposal can be applied to all types of closure elements 1 in a motor vehicle. However, the closure element 1 is preferably configured as a flap, in particular as a tailgate 1 or as a trunk lid.

According to a further teaching, which is also attributed independent significance, a closure element arrangement, in particular a tailgate arrangement, in a motor vehicle is claimed which has a closure element and a drive arrangement, as explained above. Reference can be made to the full scope of the above statements.

The invention claimed is:

1. A drive arrangement for motor-operated adjustment of a closure element in a motor vehicle, the drive arrangement comprising:

two drives, wherein each drive comprises a respective drive motor; and a drive controller;

wherein a closure element can be driven in a motor-operated adjustment mode by the drive motors, in a closing direction and in an opening direction, between a closed position and an open position;

wherein the two drives are of non-self-locking design, wherein each of the two drives has a respective sensor for sensing drive movement;

wherein the drive controller monitors signals from the sensors, correlates the signals from the sensors with one another, and detects a fault state based on the result of the correlating of the signals, the fault state comprising one of the two drives being disengaged from the closure element; and wherein upon detecting the fault state, the drive controller initiates a selected mode comprising an emergency braking mode, an emergency stop mode, or a combination of the emergency braking mode and the emergency stop mode.

2. The drive arrangement as claimed in claim 1, wherein only one of the sensors indicates the fault state, and wherein the drive controller initiates the selected mode only for a one of the two drives with the other of the sensors not indicating the fault state.

3. The drive arrangement as claimed in claim 1, wherein the fault state comprises a drive movement in the opening direction.

4. The drive arrangement as claimed in claim 3, wherein only one of the sensors indicates the fault state, and wherein the drive controller initiates the selected mode only for a one of the two drives with the other of the sensors not indicating the drive movement in the opening direction.

5. The drive arrangement of claim 3, wherein the drive movement is caused by prestressing of the two drives.

6. The drive arrangement as claimed in claim 1, wherein, in order to initiate the selected mode, the drive arrangement has an actuable brake arrangement, and the drive controller correspondingly actuates the brake arrangement.

7. The drive arrangement as claimed in claim 1, wherein, in order to initiate the selected mode, the drive controller actuates at least one of the drive motors in such a way that the at least one drive motor acts in a braking fashion on adjustment of the closure element.

8. The drive arrangement as claimed in claim 1, wherein the drive controller comprises a control loop for controlling the motor-operated adjustment of the closure element, the control loop generates a manipulated variable in the motor-operated adjustment mode on the basis of a control error, and at least one of the drive motors acts in a controlled driving fashion or controlled braking fashion as a function of the manipulated variable.

9. The drive arrangement as claimed in claim 1, wherein, in order to generate a braking effect for the selected mode, the drive controller connects at least one of the drive motors to a short circuit.

10. The drive arrangement as claimed in claim 9, wherein the short circuit is configured as an ideal electrical short-circuit bridge, or as a resistance bridge.

11. The drive arrangement of claim 10, wherein the effect of the short circuit can be set by the drive controller in that the drive controller can set the resistance value of the resistance bridge.

12. The drive arrangement of claim 9, wherein, in order to generate the braking effect, the drive controller connects the at least one of the drive motors to the short circuit in a pulsed fashion.

13. The drive arrangement of claim 12, wherein the pulsed connection takes place in pulse width modulation.

14. The drive arrangement as claimed in claim 1, wherein, in order to generate a braking effect, the drive controller applies a countervoltage, a countercurrent, or a combination of a countervoltage and a counter current to at least one of the drive motors to counteract the respective adjustment movement.

15. The drive arrangement of claim 14, wherein the drive controller applies a pulsed counter voltage, a pulsed countercurrent, or a combination of a pulsed counter voltage and a pulsed counter current to the drive motor.

16. The drive arrangement of claim 15, wherein the pulsed counter voltage, the pulsed countercurrent, or the combination of the pulsed counter voltage and the pulsed counter current is pulsed with a pulse width signal.

17. The drive arrangement as claimed in claim 1, wherein each of the two drives has a spindle gear which is connected downstream of the respective drive motor.

18. The drive arrangement of claim 17, wherein an intermediate mechanism is connected between the respective drive motor and the respective spindle gear.

19. The drive arrangement as claimed in claim 1, wherein each of the drive motors is configured as a direct current motor.

20. The drive arrangement as claimed in claim 1, wherein the closure element is configured as a tailgate or a trunk lid.

21. The drive arrangement of claim 1, wherein the drive controller correlates the signals from the sensors by comparing the sensor signals with one another.

22. The drive arrangement of claim 1, wherein the drive controller monitors the sensor signals for sudden signal deviations.

23. The drive arrangement of claim 1, wherein the fault state further comprises a fault-induced movement of the closure element in the closing direction.

24. The drive arrangement of claim 23, wherein the fault-induced movement of the closing element in the closing direction is induced by a breakage of a component of one of the two drives.

25. The drive arrangement as claimed in claim 23, wherein, in order to detect the fault-induced movement of the closure element in the closing direction, the drive controller monitors upward transgression of a predetermined limiting difference in the drive speed or the drive travel of the two drives.

* * * * *